United States Patent [19]

Batrice

[11] Patent Number: 5,074,379

[45] Date of Patent: Dec. 24, 1991

[54] AUTOMOTIVE OIL CHANGE APPARATUS

[76] Inventor: Mazen P. Batrice, 6610 Norfolk Ave., Lubbock, Tex. 79413

[21] Appl. No.: 608,194

[22] Filed: Oct. 31, 1990

Related U.S. Application Data

[62] Division of Ser. No. 386,610, Jul. 31, 1989, Pat. No. 4,977,978.

[51] Int. Cl.[5] ..... F16N 33/00

[52] U.S. Cl. ..... 184/1.5; 123/196 R

[58] Field of Search ..... 184/1.5; 123/196 R, 123/196 S

[56] References Cited

U.S. PATENT DOCUMENTS

| | | | |
|---|---|---|---|
| 2,158,914 | 5/1939 | Rinehart | 184/1.5 |
| 3,282,380 | 11/1966 | Burrell et al. | 184/1.5 |
| 4,240,523 | 12/1980 | Nestor et al. | 184/1.5 |

*Primary Examiner*—Ira S. Lazarus
*Assistant Examiner*—Alan B. Cariaso
*Attorney, Agent, or Firm*—William E. Hein

[57] ABSTRACT

An oil change apparatus for use in changing the motor oil in a motor vehicle includes a key-operated drain valve removably mounted within a lockable protective housing and a flexible line connecting the drain valve with the engine oil pan of the motor vehicle. An oil filter relocation flange and bracket accessibly mounted within the engine compartment and coupled via oil lines to the original engine block receptacle for the oil filter serves to relocate the engine oil filter to a position that provides easy access. A power assisted oil change apparatus includes an electrical pump and electromechanical valve conveniently mounted within the engine compartment of the motor vehicle for pumping used motor oil from the engine oil pan into a disposable container at oil change times.

2 Claims, 4 Drawing Sheets

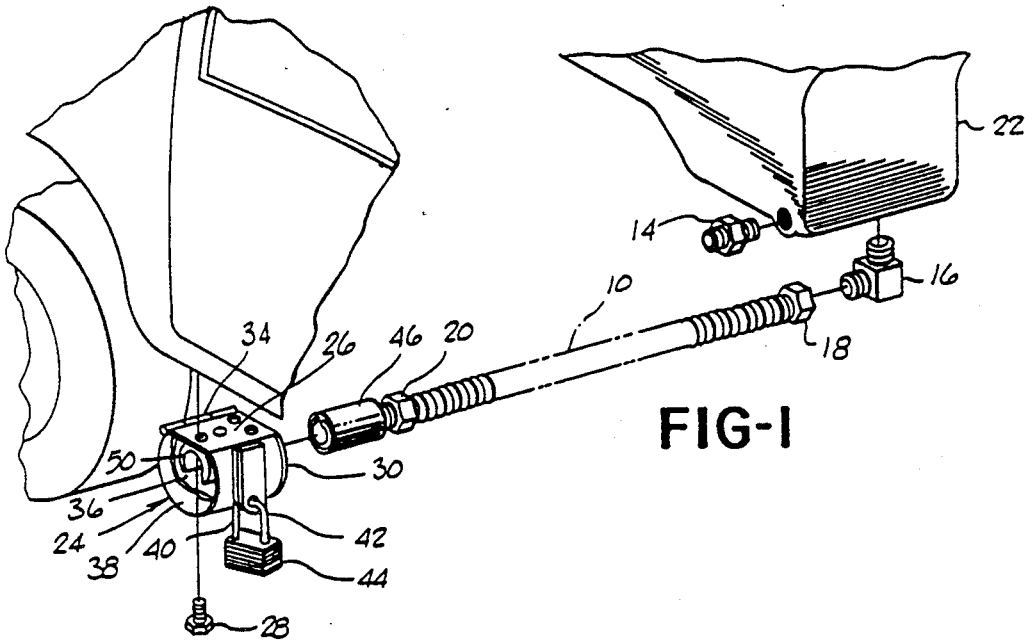
FIG-1
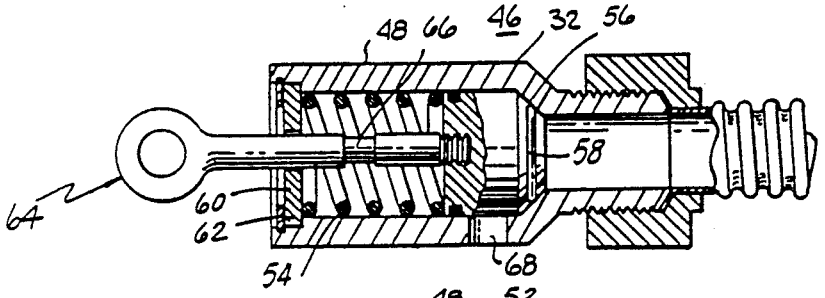
FIG-2
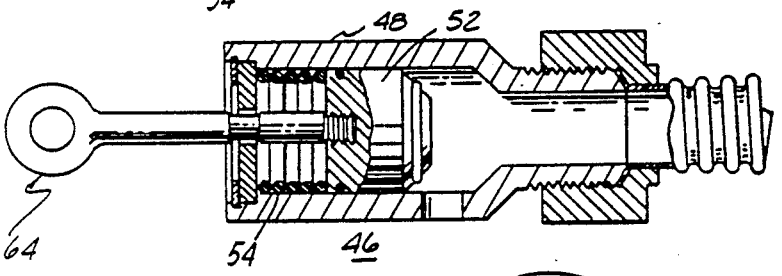
FIG-3
FIG-4.
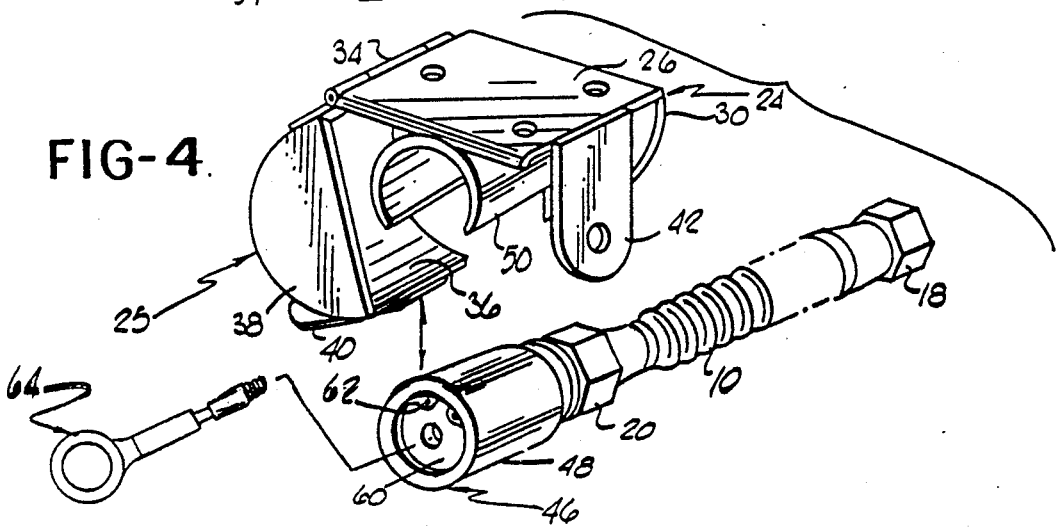

AUTOMOTIVE OIL CHANGE APPARATUS

This is a division of application Ser. No. 07/386,610 filed July 31, 1989 now U.S. Pat. No. 4,977,978.

BACKGROUND AND SUMMARY OF THE INVENTION

This invention relates generally to automobiles and other motor vehicles and more specifically to apparatus that facilitates the replacement of engine lubricating oil in such vehicles. Changing the motor oil in today's automobiles is most easily accomplished by taking the vehicle to a service station or lubrication center where the vehicle is placed on a hydraulic lift to raise it about five or six feet off the ground so that workers can easily access the engine's oil drain plug and oil filter. This procedure is somewhat expensive and time consuming for the automobile owner, given the fact that the owner must travel to and from the service facility and wait for the work to be initiated and completed. Many automobile owners would prefer to perform these periodic oil changes themselves, but are generally deterred from doing so for a number of reasons. First, the owner must crawl underneath the car while it is parked in the garage or on the driveway in order to gain access to the engine oil drain plug and oil filter. The short distance between the bottom of the vehicle and the surface on which it is parked makes this a very difficult task. At best, the owner can purchase a pair of ramps onto which the vehicle may be driven to elevate the front end an additional six to twelve inches. The owner must still crawl underneath the slightly elevated vehicle, is sure to emerge with his hands covered with dirty oil, and is likely to spill the used oil on his clothes and the garage floor or driveway during the course of draining, collecting, and removing the used oil and of removing and replacing the oil filter.

It is therefore a principal object of the present invention to provide an oil change apparatus that may be permanently mounted to a motor vehicle to facilitate quick and convenient oil changes by the owner himself. This and other objects are accomplished in accordance with one of the illustrated preferred embodiments of the present invention by providing an oil filter relocation apparatus to relocate the engine oil filter to a position of convenient and easy access by the owner. In accordance with another illustrated embodiment of the invention an oil drain apparatus having a drain valve is mounted adjacent one side of the motor vehicle where it is easily accessed by the owner for controllably draining the used motor oil into a container. In accordance with yet another illustrated embodiment of the present invention, an electrical transfer pump is permanently mounted on the vehicle and is activated by the owner to pump used oil from the motor oil pan into a disposable oil bag or container. By employing the oil change apparatus of the present invention, the do-it-yourself automobile owner is spared the grimy task of crawling underneath his vehicle to gain access to the engine oil drain plug and oil filter. The consequent spilling of used oil on the owner and on the garage floor or driveway when the oil drain plug and oil filter are removed is also eliminated. In addition, the owner can accomplish an oil change quickly, at a time that fits his schedule, and at a substantial cost saving.

BRIEF DESCRIPTION OF THE DRAWINGS

FIG. 1 is a pictorial illustration of an oil drain apparatus in accordance with the present invention.

FIG. 2 is a cross-sectional diagram of a key-operated discharge valve employed in the oil drain apparatus of FIG. 1, in which the discharge valve is illustrated in the closed position.

FIG. 3 is a cross-sectional diagram of the key-operated discharge valve of FIGS. 1 and 2, in which the discharge valve is illustrated in the open or drain position.

FIG. 4 is a detailed pictorial illustration of the key-operated discharge valve and associated housing of FIGS. 1–3 showing the discharge valve disconnected from its housing.

DESCRIPTION OF THE PREFERRED EMBODIMENT

Figure 5:
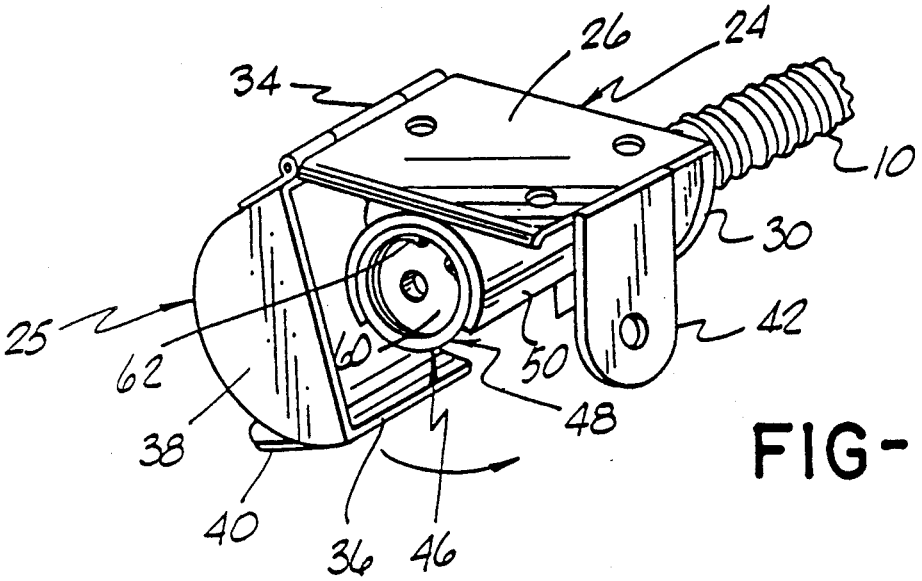
FIG. 5 is a detailed pictorial illustration of the key-operated discharge valve and associated housing of FIGS. 1–4 showing the discharge valve connected to its housing.

Referring now to FIG. 1, there is shown a pictorial illustration of an oil drain apparatus constructed in accordance with the present invention. The oil drain apparatus includes a length of commonly available flexible steel line 10 that includes nut connectors 18 and 20 on either end thereof. Connection of flexible steel line 10 to the drain plug opening of a motor vehicle oil pan 22 is made by way of a connector 14 in the case of oil pans having a side drain plug and by way of a 90-degree connector 16 in the case of oil pans having a bottom drain plug. Attachment of the distant end of flexible steel line 10 is made to a discharge valve assembly via nut connector 20.

The discharge valve assembly includes a steel housing 24 having a chassis mounting plate 26 for mounting the discharge valve assembly to the motor vehicle chassis via a plurality of bolts 28. Preferably, the discharge valve assembly is mounted underneath the motor vehicle adjacent one side thereof in generally direct alignment with the existing drain plug hole on oil pan 22. This choice of alignment usually results in positioning the discharge valve assembly somewhat behind one of the front wheels of the motor vehicle. By so positioning the discharge valve assembly, it is readily accessible to the owner who wishes to change the vehicle's motor oil, without the usual necessity of crawling underneath the vehicle to remove and reinstall the oil drain plug. Housing 24 of the discharge valve assembly includes a rear plate 30 and a curved side member 32 that are fixedly attached to chassis mounting plate 26. A hinged portion 25 of housing 24 is connected to chassis mounting plate 26 via a hinge 34 and includes a curved side member 36 and a front plate 38. The hinged portion 25 of housing 24 serves to cover the interior of the discharge valve assembly when not in use and to expose it to the owner when it is desired to change the vehicle's motor oil. A depending ear 40 on the hinged portion 25 of housing 24 is aligned with a similar depending ear 42 on curved side member 32 when the hinged portion 25 of housing 24 is in the closed position so that the hinged portion 25 can be secured in the closed position by means of a padlock or other fastener 44.

Figure 6:
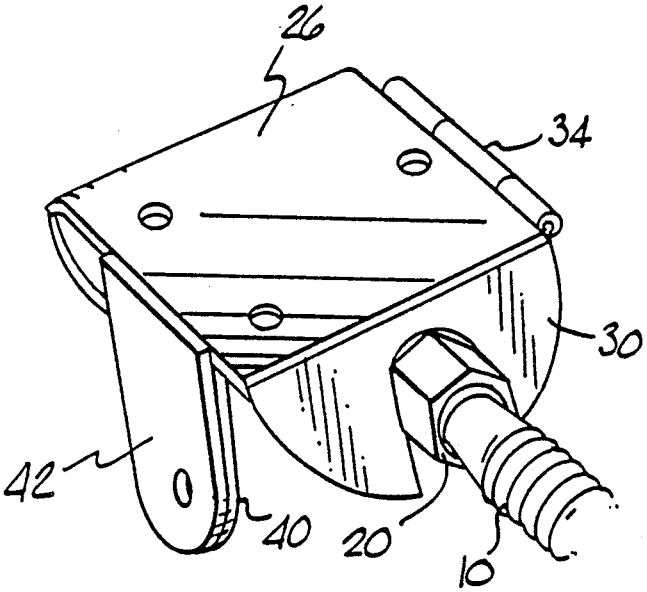
FIG. 6 is a detailed pictorial illustration showing the rear of the discharge valve housing of FIGS. 1, 4, and 5.

The discharge valve assembly includes a discharge valve 46 that is connected to the distant end of flexible steel line 10 by way of nut connector 20. As illustrated in detail in FIGS. 2–6, discharge valve 46 comprises a generally circular valve housing 48 that is removably retained within a semicylindrical plastic retainer 50 mounted to chassis mounting plate 26 within housing 24. Plastic retainer 50 is fabricated so that discharge valve 46 may be snapped into a retained position as shown in FIGS. 5 and 6 or into a disconnected position as shown in FIG. 4. A valve member 52 is arranged for slidable motion within valve housing 48 against the force of a spring 54. Spring 54 urges valve member 52 against a seat 56 formed by a taper at one end of valve housing 48. A rubber 0-ring 58 serves as a seal between valve member 52 and seat 56. At the end of valve housing 48 opposite seat 56 an end plate 60 and retaining ring 62 hold spring 54 in a partially compressed position within valve housing 48. A removable cylindrical key 64 is adapted to be inserted through a central opening in end plate 60 and to be threadably connected to valve member 52. When so connected, key 64 may be operated against the force of spring 54 until a detent 66 in a shaft portion of key 64 engages the periphery of the central opening in end plate 60, thereby holding valve member 52 in a retracted or open position permitting oil to drain from oil pan 22 through flexible steel line 10 and through an opening 68 at the bottom of valve housing 48 into an external container.

To use the oil drain apparatus described hereinabove, the motor vehicle owner simply places a catch container beneath the discharge valve assembly mounted adjacent the side of the motor vehicle and behind one of its front wheels. Lock 44 is then unlocked and the hinged portion of housing 24 is swung into the open position, exposing discharge valve 46, as illustrated in FIGS. 4 and 5. If required, based on convenience and gravity flow considerations, the discharge valve 46 may be disconnected from housing 24 and positioned as desired over the catch container, as illustrated in FIG. 4. Key 64 is then inserted through the central opening in end plate 60 of discharge valve 46, screwed into valve member 52, and retracted to engage detent 66 with the periphery of the central opening in end plate 60, thereby opening discharge valve 46 so that used oil residing in motor oil pan 22 will drain by gravity into the external catch container. When draining is complete, the detent in the shaft portion of key 64 is disengaged from the periphery of the central opening in end plate 60, thereby closing discharge valve 46 by permitting spring 54 to urge valve member 52 against seat 56. Key 64 is then unscrewed from valve member 52, removed from discharge valve 46, and stored in a safe place in anticipation of its subsequent use. The hinged portion of housing 24 is then swung into the closed position illustrated in FIGS. 1 and 6, and lock 44 is replaced, thereby protecting discharge valve 46 and preventing tampering therewith.

Figure 7:
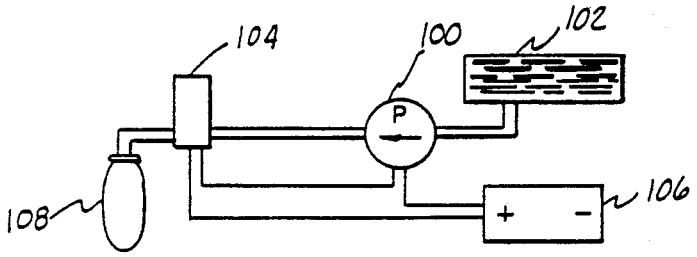
FIG. 7 is a block diagram of a pump driven oil drain apparatus in accordance with the present invention.
Figure 11:
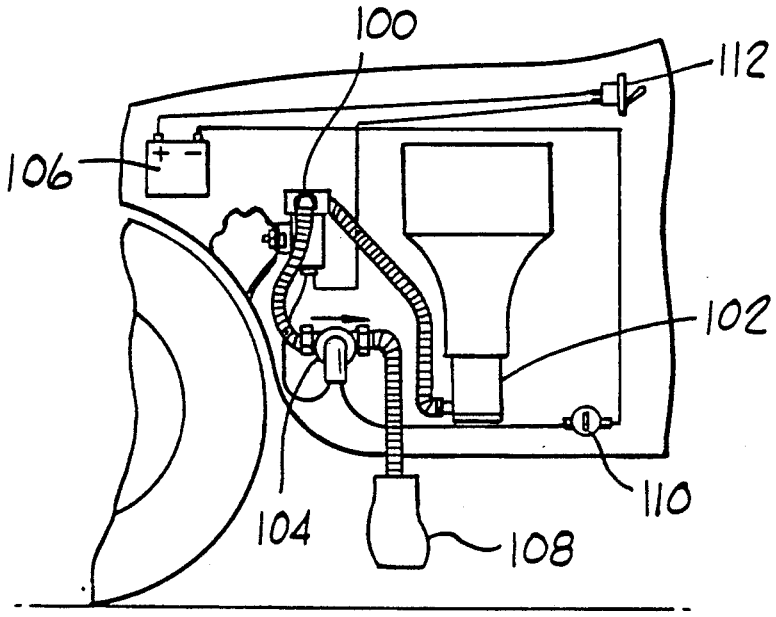
FIG. 11 is a pictorial diagram illustrating the relative positioning of the components of the pump driven oil drain apparatus of FIG. 7.

Referring now to FIG. 7, there is shown a block diagram of an alternative oil drain system that may be activated by the motor vehicle owner to pump used oil from the motor oil pan 102 into a disposable container 108. Since this oil drain system does not depend on gravity flow for removal of oil from the motor oil pan, the various structural components may be mounted anywhere under the hood of the motor vehicle. For example, a pump and electromechanical valve employed in this oil drain system may be positioned at points that are higher than the oil pan 102, as illustrated in FIG. 11. It is, of course, desirable to position the disposable container for the used oil where it may be easily removed by the owner when the pumping operation has been completed. Referring to FIGS. 7 and 11, this system includes a pump 100, that may comprise a 12-volt centrifugal transfer pump such as the Model 367-12V manufactured by Proven Pumps Corporation, Inc., 1440 North Spring Street, Los Angeles, California 90012. The intake of pump 100 is connected to the motor oil pan 102 by removing the existing oil drain plug. The outlet of pump 100 is connected to an electromechanical valve 104 that may comprise, for example, a 12-volt solenoid (coil Model 75520, valve Model GP400) maufactured by Fluidex Division-Jackes Evans Controls, Parker Hannifin Corporation, Madison, Mississippi 39110. Pump 100 and electromechanical valve 104 are electrically, switchably connected by means of a vehicle ignition switch 10 and a pump switch 112, to the motor vehicle's battery 106. Any of a number of commercially available disposable oil bags 108 having a cap or a self-sealing feature may be connected to receive oil at the outlet of electromechanical valve 104. Following attachment of an oil bag 108 to the outlet of electromechanical valve 104, the owner electrically activates pump 100 and valve 104 to initiate the pumping operation that removes used motor oil from motor oil pan 102 and transfers it to disposable oil bag 108. When the transfer is complete, oil bag 108 is removed and new motor oil may be added to the vehicle engine.

Figure 10:
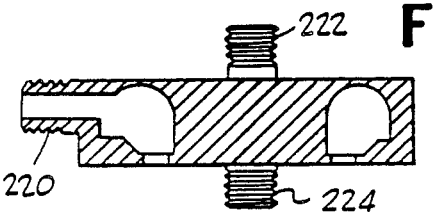
FIG. 10 is a cross-sectional diagram of a portion of an oil filter retaining bracket employed in the oil filter relocation apparatus of FIG. 8.
Figure 8:
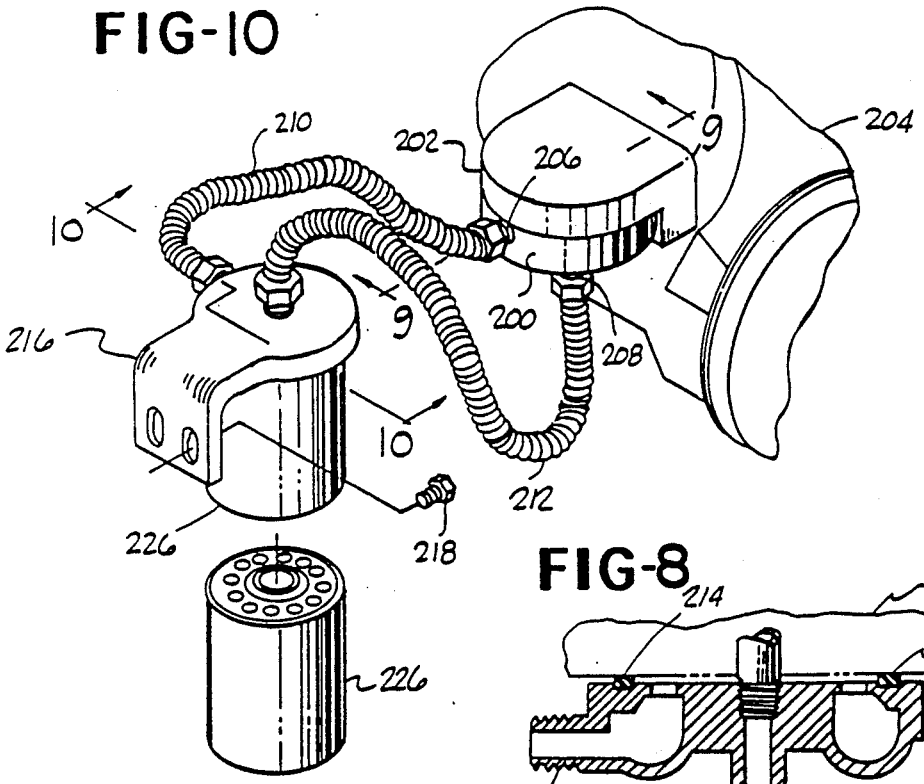
FIG. 8 is a pictorial diagram of an oil filter relocation apparatus constructed in accordance with the present invention.
Figure 9:
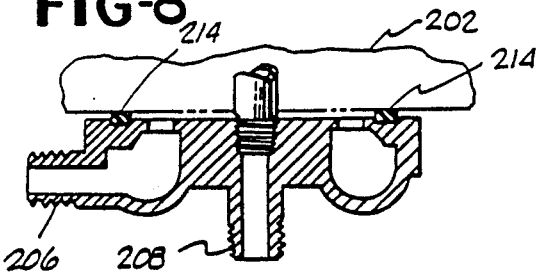
FIG. 9 is a cross-sectional diagram of an oil filter replacement element employed in the oil filter relocation apparatus of FIG. 8.

Referring now to FIGS. 8–10, there is shown an oil filter relocation apparatus constructed in accordance with the present invention that serves to relocate the motor vehicle's oil filter to a more easily accessible location within the engine compartment of the vehicle. This feature of the present invention eliminates the difficulties encountered in removing and replacing most engine oil filters, which are generally positioned in hard-to-reach locations, oftentimes accessible only from underneath the vehicle. An oil filter replacement flange 200 is adapted for connection to an original equipment oil filter receptacle 202 on engine block 204. Oil filter replacement flange 200 is illustrated in cross-sectional detail in FIG. 9. First and second ports 206 and 208, repsectively, are provided for connection to respective flexible lines 210 and 212. A rubber gasket 214 provides a seal between oil filter replacement flange 200 and receptacle 202. An oil filter replacement flange and bracket assembly 216 is provided for mounting to any easily accessible location on the vehicle firewall or front wheel wells, for example, by means of bolts 218. Oil filter replacement flange and bracket assembly 216 is illustrated in cross-sectional detail in FIG. 10. First and second ports 220 and 222, resepctively, are adapted to receive flexible lines 210 and 212, respectively. A third port 224 is adapted to receive a conventional spin-on oil filter of the same type originally received by original equipment oil filter receptacle 202 on engine block 204. From the above description and associated drawing FIGS. 8–10, it will be appreciated that the oil filter relocation apparatus of the present invention is very effective in repositioning the vehicle's engine oil filter to a desired location under the hood that makes it more accessible to the owner at oil change times than was the oil filter originally located on the engine block.

What is claimed is:

1. Power assisted oil change apparatus for use in changing the motor oil in a motor vehicle, the apparatus comprising:

electrical pump means coupled to an engine oil pan of said motor vehicle for pumping used motor oil from the engine oil pan, said electrical pump means including integral motor driving means and being mounted at a point on said motor vehicle that is higher than said engine oil pan;

electromechanical valve means coupled to a discharge port of said electrical pump means, said electromechanical valve means including an outlet port and being mounted at a point on said motor vehicle that is higher than said engine oil pan;

switch means coupled to a battery of the motor vehicle and to said electrical pump means and electromechanical valve means for simultaneously applying battery voltage to said electrical pump means and electromechanical valve means to initiate a flow of oil from said engine oil pan; and a disposable container coupled to the outlet port of said electromechanical valve means for receiving the motor oil pumped from the engine oil pan.

2. Power assisted oil change apparatus as in claim 1 wherein said electrical pump means and said electrical valve means are mounted within an engine compartment of the motor vehicle.

* * * * *